United States Patent [19]

Luallen

[11] Patent Number: 4,916,265

[45] Date of Patent: Apr. 10, 1990

[54] ADJUSTABLE MOUNTING ASSEMBLY FOR A LIMIT SWITCH

[75] Inventor: Richard L. Luallen, New Albany, Ind.

[73] Assignee: Gary D. Thomas, DePauw, Ind. ; a part interest

[21] Appl. No.: 273,845

[22] Filed: Nov. 21, 1988

[51] Int. Cl.[4] ..... H01H 3/16

[52] U.S. Cl. ..... 200/47; 200/294

[58] Field of Search ..... 200/47, 286, 294; 248/657

[56] References Cited

U.S. PATENT DOCUMENTS

| | | | |
|---|---|---|---|
| 2,284,404 | 5/1942 | Martin | 200/47 |
| 3,652,044 | 3/1972 | Manross | 248/657 |
| 3,936,620 | 2/1976 | Williamson | 200/47 |

*Primary Examiner*—Renee S. Luebke

*Attorney, Agent, or Firm*—Maurice L. Miller, Jr.

[57] ABSTRACT

An adjustable mounting assembly for a limit switch is disclosed which includes a stationary H-shaped base plate attachable to a machine table, a movable plate slidably mounted on the base plate upon which a limit switch is carried, an adjusting screw interconnecting the plates, and locking screws which are inserted through elongated slots in one of the plates into threaded holes in the other plate which lie along the centerline of the slots for locking the plates together once the desired position of the switch has been obtained. The assembly is adaptable for moving the switch along its longitudinal centerline, along a line parallel with the table and perpendicular to its longitudinal centerline, or in a direction normal to the table and perpendicular to its longitudinal centerline. The movable plate contains at least one tab which projects into one of two outwardly opening slots in the base plate which are separated by a cross member. The adjusting screw extends through an untapped hole in one of the tabs and is threadably inserted into a tapped passageway which extends through the cross member. An E-ring contained in a circular groove on an untapped neck portion of the screw holds the screw head closely against the tab through which the screw is inserted so that rotation of the screw and its movement through the passageway produces corresponding movement of the movable plate.

17 Claims, 4 Drawing Sheets

FIG. 13
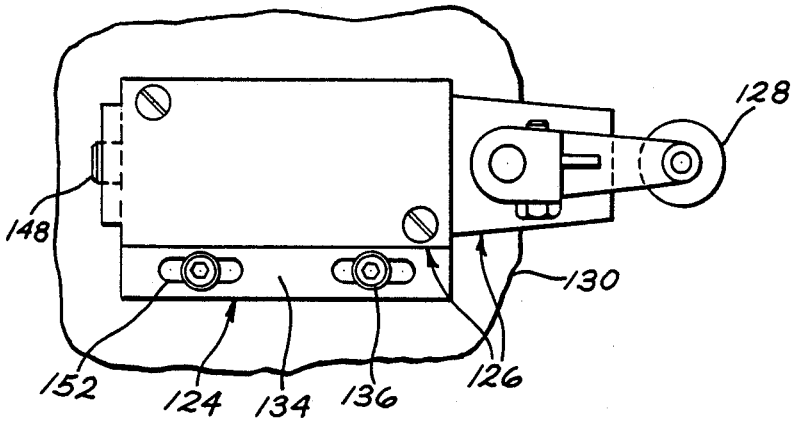
FIG. 14
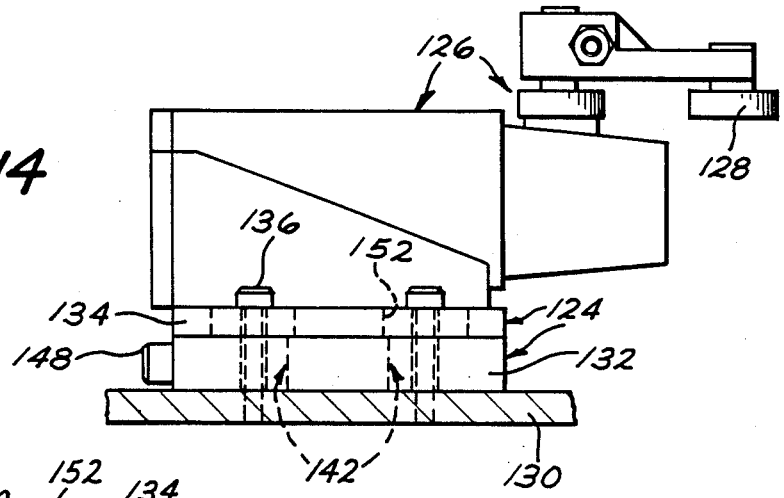
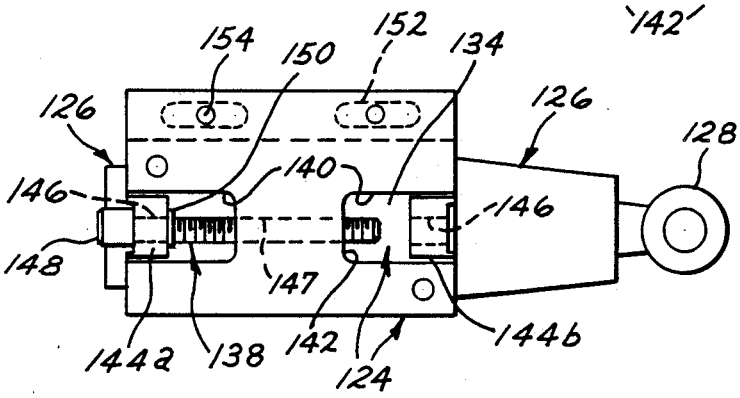
FIG. 15

ADJUSTABLE MOUNTING ASSEMBLY FOR A LIMIT SWITCH

BACKGROUND OF THE INVENTION

This invention relates generally to means for adjustably mounting a limit switch to a machine table or other supporting surface. More specifically, the invention relates to an adjustable mounting assembly which includes a movable switch supporting plate slidably mounted on a stationary base plate having an adjusting means interconnected between the two plates for precisely adjusting the position of the switch for accurate control of machinery.

Several different forms of adjustable mounting assemblies for precisely adjusting the position of a limit or stop switch carried thereby are known in the prior art. One such example is an automatic stop switch for a lathe as disclosed in U.S. Pat. No. 2,255,706 issued to L. H. Height on Sep. 9, 1941. In that example, a box containing a longitudinally displaceable, spring returned stop switch rod projecting therefrom is carried by an angle member extending downwardly from a block. The block is, in turn, slidably mounted on a rail having a guide rib extending therealong. A tie bolt connected through the block and angle member secures the block and box containing the stop switch rod at the desired position along the rail and guide rib relative to a moving part of a lathe. By simply loosening the tie bolt, the block, angle member and box containing the stop switch rod can be slid along the rail and rib to any desired position to selectively limit the length of movement of the moving lathe part.

An example of an adjustable mounting assembly for a pair of limit switches known in the prior art is that disclosed in U.S. Pat. No. 2,566,824 issued to G. K. Carlson on Sep. 4, 1951. That assembly incudes an operating nut which travels along a rotatable threaded shaft and a smooth guide shaft between a pair of switch contact arms. A frame of the assembly contains two blocks pivotally mounted thereon over two arc shaped slots in the frame. The contact arms are movably mounted on the sides of the blocks and extend upwardly on opposite sides of a contact finger carried by the nut such that they are positioned to engage the nut when the latter has traveled a predetermined distance. Each block contains a dog having a pin projecting therefrom into a different one of the slots in the frame. A pair of adjustment screws are interconnected between an edge of the frame and a different one of the dogs. Each of the screws contains a spring thereon which is maintained in compression between an edge of the frame and a dog. By turning one of the screws, one of the pins moves in the slot to cause the corresponding block to pivot so that its corresponding contact arm moves toward or away from one side of the contact finger of the traveling nut. The other block and its corresponding contact arm is adjusted in the same manner. Accordingly, the total length of travel of the nut can be precisely controlled within certain limits.

One difficulty encountered with the prior art adjustable mounting assemblies just described is the relatively large number of parts and complicated construction involved in each one. Another problem so far as the subject lathe stop switch is concerned is its limitation to use on machinery which has a rail and guide rib thereon properly aligned relative to the moving part which is to contact the switch.

By means of my invention, these and other difficulties encountered with prior art adjustable mounting assemblies for limit switches are substantially reduced if not altogether eliminated.

SUMMARY OF THE INVENTION

It is an object of my invention to provide a precisely adjustable mounting assembly for a limit switch.

It is a further object of my invention to provide an adjustable mounting assembly for a limit switch which is adapted to move the switch to various selected positions along its longitudinal centerline.

It is another object of my invention to provide an adjustable mounting assembly for a limit switch which is adapted to move the switch to various selected positions parallel to a supporting surface of said assembly and perpendicular to a longitudinal centerline of said switch.

It is also an object of my invention to provide an adjustable mounting assembly for a limit switch which is adapted to move the switch to various selected positions normal to a supporting surface of said assembly and perpendicular to a longitudinal centerline of said switch.

Briefly, in accordance with my invention, there is provided an adjustable mounting assembly for a limit switch which includes a stationary base plate, means for securing the base plate to a supporting surface and a movable plate slidably disposed on the base plate for supporting a limit switch thereon. An adjusting means is also provided which is interconnected between the base plate and the movable plate for slidably moving the movable plate on the base plate to precisely adjust the position of the switch relative to the base plate and supporting surface. Lastly, there is included locking means for securing the movable plate to the base plate for maintaining a selected position of the switch.

These and other objects, features and advantages of the present invention will become apparent to those skilled in the art from the following detailed description and attached drawings upon which, by way of example, only the preferred embodiments of my invention are explained and illustrated.

BRIEF DESCRIPTION OF THE DRAWINGS

FIGS. 13–15 show a top plan view, side elevation view and bottom plan view, respectively, of an adjustable mounting assembly for a conventional limit switch adapted for adjustment of the position of the switch along its longitudinal centerline, thus illustrating another preferred embodiment of my invention.

DESCRIPTION OF THE PREFERRED EMBODIMENTS

Figure 1:
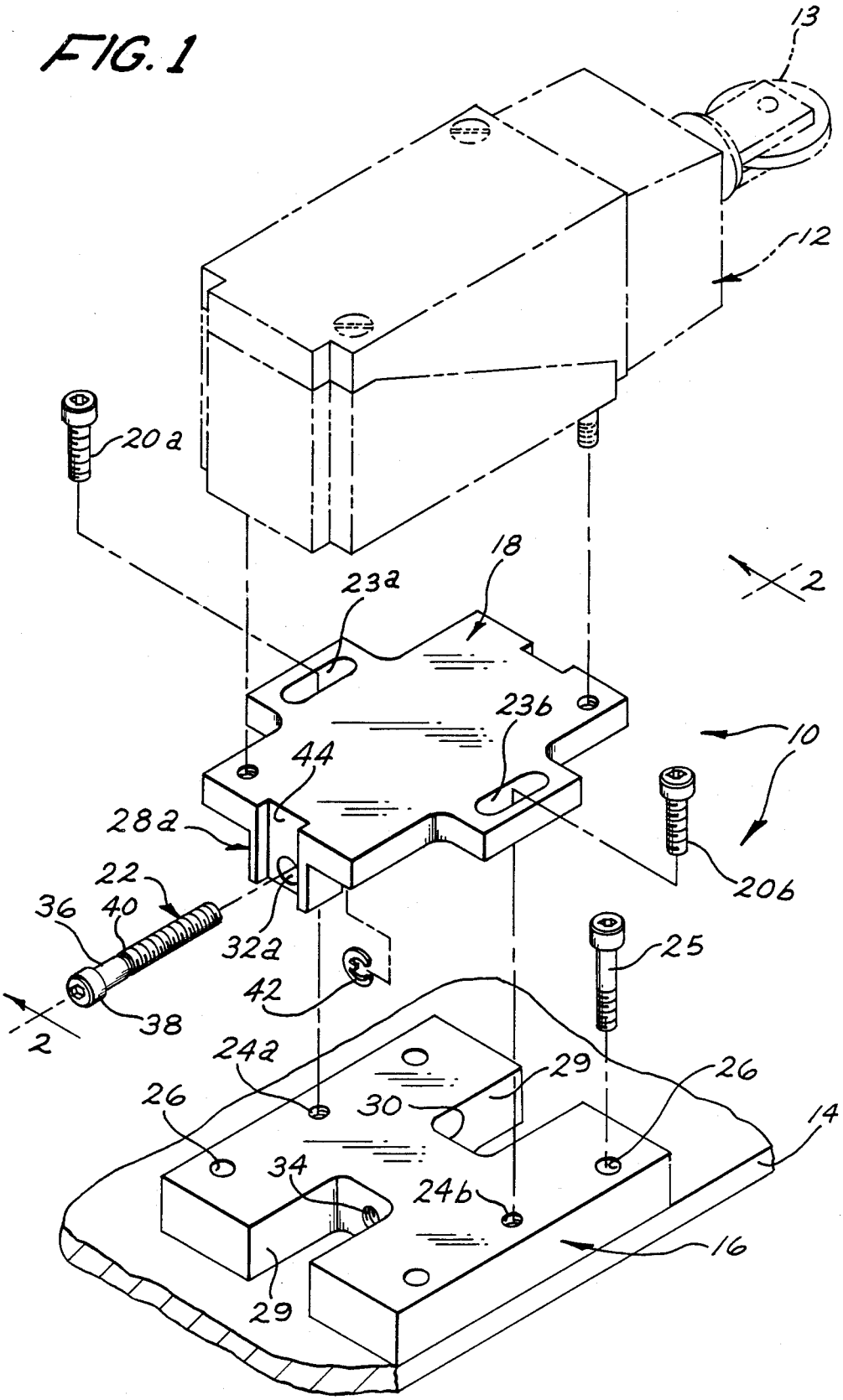
FIG. 1 shows an exploded perspective view of an adjustable mounting assembly for a conventional limit switch adapted for longitudinal switch adjustment, thus illustrating one preferred embodiment of my invention.

Referring now to the drawing figures and specifically to FIGS. 1–6, there is shown in one preferred embodiment of my invention an adjustable mounting assembly 10 for use with a conventional limit switch 12. The assembly 10 of the present example is adapted for making precise longitudinal adjustments in the position of the switch 12 and its switch head 13 along a supporting surface such as that of a machine table 14. The assembly 10 includes a stationary, H-shaped base plate 16 which is directly attachable to the table 14, a movable switch mounting plate 18 which is slidably attached to the stationary base plate 16, a pair of locking screws **20*a* and 20*b* for securing the movable plate 18 to the stationary plate 16, and an adjustment screw 22 for changing the position of the movable plate 18 relative to the stationary plate 16 to adjust the position of the switch 12** along its longitudinal centerline.

Figure 4:
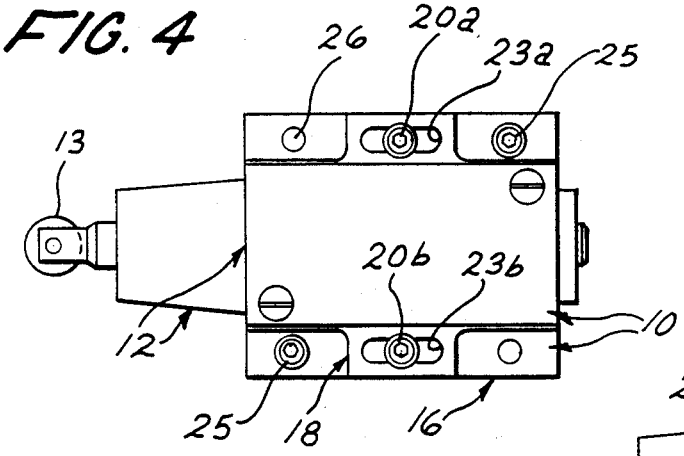
FIGS. 4–6 show a top plan view, bottom plan view and side elevation view, respectively, of the adjustable mounting assembly and limit switch of FIGS. 1–3.
Figure 5:
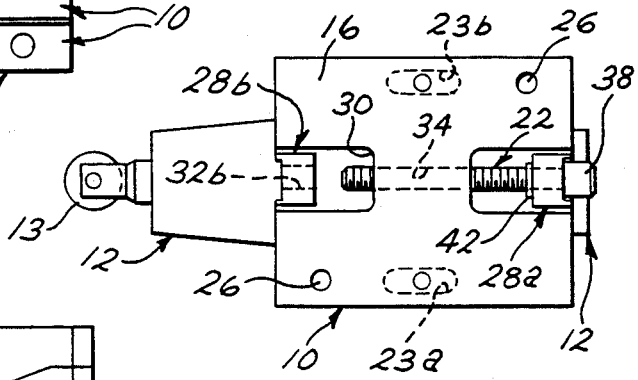
Figure 6:
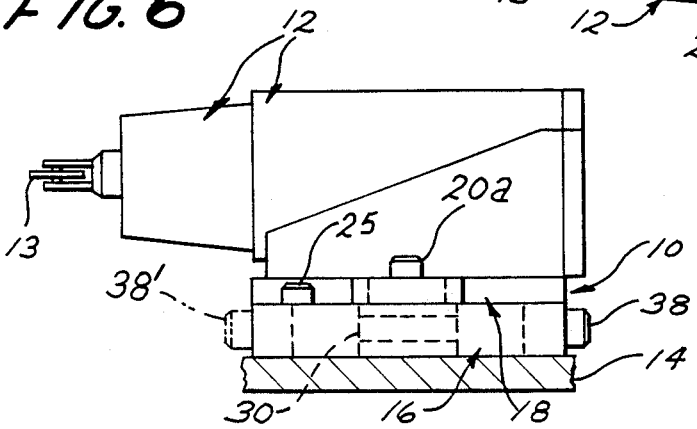

To fasten the plates 16 and 18 together, the locking screws **20*a* and 20*b* are inserted through a pair of elongated slots 23*a* and 23*b* which are located in opposite side edge portions or wings of the plate 18 which extend outwardly beyond the sides of the switch 12. Thereafter, the screws 20*a* and 20*b* are threadably inserted into tapped holes 24*a* and 24*b* in the plate 16, which holes are located on the longitudinal centerline of the slots. The side edge portions of the plate 18 which contain the slots 23*a* and 23*b* project laterally outward beyond opposite sides of the switch 12 to provide clearance to permit insertion and removal of the screws 20*a* and 20*b* into and from the slots when the switch 12 is attached to the plate 18** as best seen in FIG. 4.

The stationary plate 16 is secured to the table 14 by means of suitable threaded fasteners 25, only one of which is shown, which are inserted downwardly through untapped clearance holes 26 located in outer corner portions of the legs of the plate 16 and into tapped holes placed in the table 14 for registering with the holes 26. The movable plate 18 contains a pair of outwardly projecting end tabs **28*a* and 28*b* which project into outwardly opening slots 29 located on opposite sides of a cross member 30 of the stationary plate 16. The adjustment screw 22 is thereafter inserted through an untapped clearance hole 32*a* in the tab 28*a* and threaded into a tapped passageway or hole 34 which extends through the cross member 30**.

Figure 2:
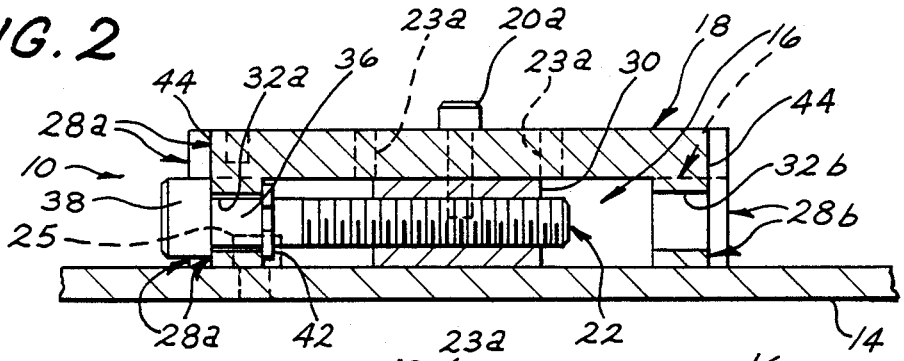
FIG. 2 shows a cross-sectional side elevation view of the mounting assembly of FIG. 1 as viewed along cross-section lines 2—2 of the latter figure, illustrating a centered position of a slidable plate of the assembly relative to a stationary plate thereof.
Figure 3:
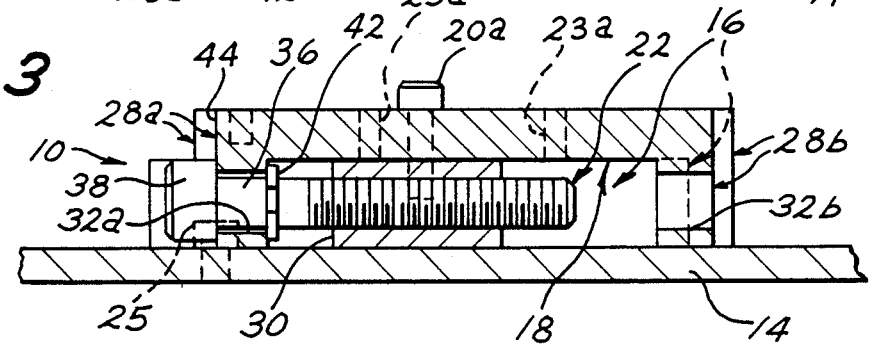
FIG. 3 shows a cross-sectional side elevation view of the mounting assembly of FIG. 1, the same as viewed in FIG. 2, illustrating an extended position of the slidable plate of the assembly relative to the stationary plate as viewed.

The screw 22 contains an unthreaded neck portion 36 near a screw head 38 which extends through the untapped hole **32*a* and slightly inward beyond an inwardly facing surface of the tab 28*a* when the screw head 38 is flush against the tab 28*a* as best seen in FIGS. 2–3. The screw head 38 is of larger diameter than its shank and the clearance hole 32*a* so that the screw head 38 can be made to rest flush against the outwardly facing surface 44 of the tab 28*a*. A circular groove 40 is formed on and around the neck portion 36 just inwardly of the inwardly facing surface of the tab 28*a* when the screw 22*b* is in the position shown in which an E-ring 42 is placed to hold the head 38 against an outer wall 44 of the tab 28*a* at all times regardless of adjustments in the screw 22. Since a central portion of the tab 28*a* is thus closely confined between the screw head 38 and the E-ring 42, the plate 18 can be moved back and forth along the centerline of the screw 22 relative to the plate 16 as the screw 22 is adjusted for movement back and forth through the passageway 34 to precisely position the switch 12 longitudinally. This action occurs because the screw 22 moves into and out of the cross-member 30 carrying the tab 28*a* and remainder of the plate 18 with it. By turning the screw 22 in one direction, the plate 18 moves from left to right as viewed, from a retracted position relative to the plate 16, as shown in FIG. 2, to an extended or advanced position relative to the plate 16 as shown in FIG. 3. Conversely, by turning the screw 22 in the opposite direction, the plate 18 will move from right to left as viewed, from the advanced position relative to the plate 16** as shown in FIG. 3 to the retracted position as shown in FIG. 2.

To make such adjustments, of course, the locking screws **20*a* and 20*b* must first be loosened from the plate 18. After the desired adjustment has been made, the locking screws 20*a* and 20*b* are tightened against the plate 18 to secure the latter in the desired position relative to the plate 16. It should be noted that the screw 22 can, in the alternative, be inserted through the untapped hole 32*b* in the opposite end tab 28*b* so that the screw 22 can be threaded into the tapped hole 34 in the cross member 30** from the opposite direction.

Figure 7:
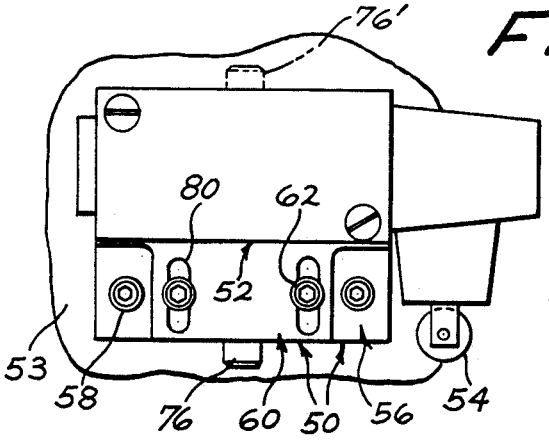
FIGS. 7–9 show a top plan view, bottom plan view and side elevation view, respectively, of an adjustable mounting assembly for a conventional limit switch adapted for lateral switch adjustment parallel to a supporting surface and perpendicular to a longitudinal centerline of the switch, thus illustrating another preferred embodiment of my invention.
Figure 8:
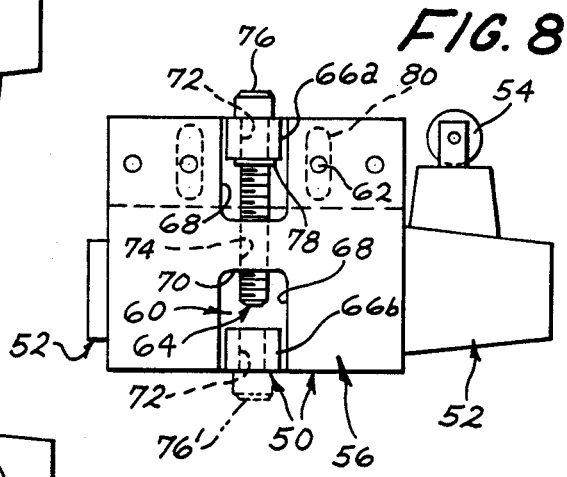
Figure 9:
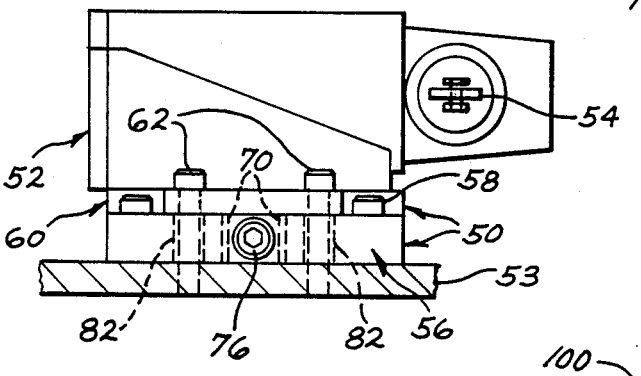

Referring now to FIGS. 7–9, there is shown in another preferred embodiment of my invention an adjustable switch mounting assembly 50 for use with a conventional limit switch 52. The assembly, 50 of the present example is adapted for making precise sidewise adjustments of the switch 52 and its switch head 54 parallel to a supporting surface 53 and perpendicular to the longitudinal centerline of the switch. As in the previous example, the assembly 52 includes a stationary H-shaped base plate 56 adapted for securing to a machine table by means of suitable threaded fasteners 58, a movable plate 60 slidably attached to the base plate 56, a pair of locking screws 62 for locking the plates 56 and 60 securely together, and an adjustment screw 64 for adjusting the position of the plate 60 relative to the plate 56 when the locking screws 62 are loosened from the first mentioned plate.

The movable plate 60 contains a pair of downwardly projecting tabs **66*a* and 66*b* which insert into outwardly opening slots 68 defined by the plate 56, which slots are separated by a cross member 70. The tabs 66*a* and 66*b* contain untapped holes 72 therethrough which register with a tapped hole 74 through the cross member 70 when the plates 56 and 60 are assembled as shown. The adjusting screw 64 is inserted into the untapped hole 72 of the tab 66*a* and thereafter threadably inserted into the tapped hole 74 such that its screw head 76 is flush against the outwardly facing surface of the tab. In such a position, an untapped portion of the screw 64 extends through the untapped hole 72 in the same manner as the screw 22 of the previous example. A circular groove is formed on this untapped portion so that the groove will lie just inward of the inwardly facing surface of the tab 66a when the screw head 76 is flush against the tab as shown. As in the previous example, an E-ring 78 is snapped into the groove so as to hold the screw head 76 against the tab 66a** at all times.

The locking screws 62 are inserted through a pair of spaced laterally extending elongated slots 80 located on one side portion of the plate 60 which projects beyond one side of the switch 52. To lock the plates 56 and 60 securely together, the screws 62 are also threadably inserted into tapped holes 82 in the base plate 56 which register with the overlying slots 80. To adjust the plate 60 across the plate 56, the screws 62 are first loosened from the plate 60 after which the screw 64 is turned in one direction or the other to cause the screw 64 to move forwardly or backwardly in and along the tapped hole 74 in the cross member 70 to move the tab 66a toward or away from the cross member 70. As in the previous example, the screw 64 can also be inserted through the opposite side tab 66b and into the tapped hole 74 in the cross member 70 from the opposite direction from that shown in full in FIGS. 7–9. The screw head 76' shown in phantom in FIG. 7 illustrates insertion of the screw 64 through the tab 66b in such opposite direction.

Figure 10:
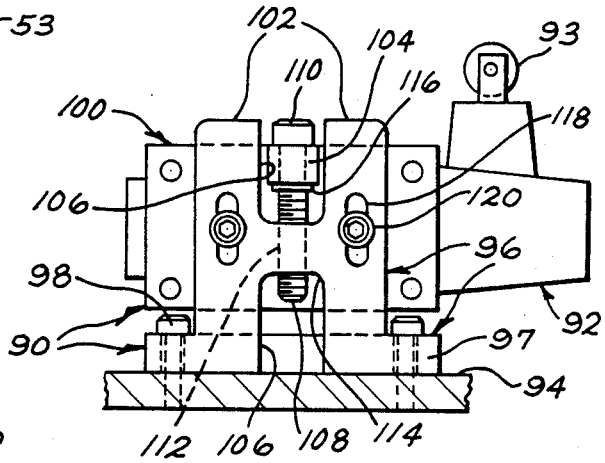
FIGS. 10–12 show a side elevation view, bottom plan view and top plan view, respectively, of an adjustable mounting assembly for a conventional limit switch adapted for switch adjustment normal to a supporting surface and perpendicular to a longitudinal centerline of the switch, thus illustrating another preferred embodiment of my invention.
Figure 11:
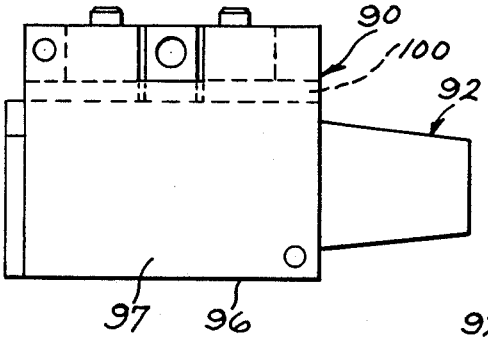
Figure 12:
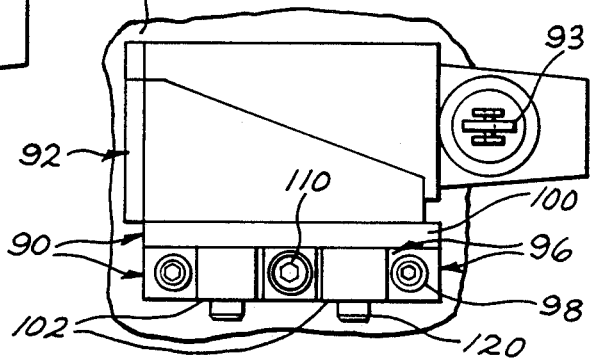

Referring now to FIGS. 10–12, there is shown in another preferred embodiment of my invention an adjustable mounting assembly 90 for a conventional limit switch 92. The assembly 90 of the present example is adapted for precise adjustment in the position of the switch 92 and its switch head 93 in a direction normal to a mounting surface 94. The assembly 90 includes a right angle shaped stationary member 96 attached on a base portion 97 thereof by means of suitable threaded fasteners 98 to the surface 94. Also included is a flat, rectangularly shaped movable plate 100 mounted against an upright, H-shaped portion 102 of the member 96. The plate 100 includes a single outwardly extending tab 104 projecting into an upwardly opening slot 106 formed in the portion 102. An adjusting screw 108 having a screw head 110 of larger diameter than its shank extends through an untapped hole in the tab 104 and is threadably inserted into a tapped hole 112 which extends through a cross member 114 of the upright portion 102.

The portion of the screw 108 which extends through the untapped hole in the tab 104 when the screw head 110 is flush against the upper surface of the tab 104 is unthreaded. A circular groove is formed in a lower part of the unthreaded portion of the screw 108 at a position just below the lower surface of the tab 104 when the screw head 110 is flush with the upper surface thereof so that an E-ring 116 can be snapped into the groove to maintain the screw head 110 flush against the tab 104 at all times. A pair of spaced, vertically extending slots 118 are formed in the legs of the upright H-shaped portion 102 through which a pair of locking screws 120 are inserted and thereafter threaded into tapped holes in the plate 100 to secure the plate 100 at the desired position to the upright portion 102.

To adjust the plate 100 upon which the switch 92 is mounted upwardly or downwardly for precisely locating the vertical position of the switch head 93, the locking screws 120 are loosened from the slots 118 after which the screw 108 is turned in one direction or the other to advance the screw head 110 downwardly toward or to retract it upwardly away from the cross member 114. Because the tab 104 is confined between the screw head 110 and the E-ring 116, it and the remainder of the plate 100 will travel upwardly and downwardly with the vertical movement of the screw 108 in and along the tapped hole 112 of the cross member 114. It will be appreciated that the plate 100 can be mounted against the portion 102 such that the tab 104 projects into the downwardly opening slot 106 and such that the screw 108 extends through the tab upwardly into the passageway 112 in the opposition direction as shown.

Referring now to FIGS. 13–15, there is shown in another preferred embodiment of my invention an adjustable mounting assembly 124 for a conventional limit switch 126 wherein the assembly 124 is adapted for adjustment of the position of the switch 124 and its switch head 128 along its longitudinal centerline, the same as in the example in FIGS. 1–6. In this example, however, the assembly 124 is connected to a supporting surface or machine table 130 along only a single side thereof rather than on both sides thereof as in the first example. The assembly 124 includes a generally H-shaped, flat, stationary base plate 132, a flat movable rectangularly shaped plate 134, a pair of locking screws 136 and an adjustment screw 138. As in the previous examples, the base plate 132 contains a pair of outwardly open slots 140 on opposite ends thereof which define a cross member 142. The plate 134 contains a pair of outwardly extending tabs 144a and 144b located on opposite end portions thereof which project into the slots 140 of the plate 132. The tabs 144a and 144b contain untapped openings 146 therethrough, through either one of which an untapped portion of the screw 138 extends. A threaded portion of the screw 138 is threadably received in a tapped hole 147 which extends through the cross member 142. A circular groove is formed on one end of the untapped portion of the screw 138 so as to be in a position just inwardly of the tab 144a or 144b when the screw 138 is inserted therein so that its screw head 148 is flush against an outer portion of the tab. A circular E-ring 150 is snapped into the groove when the screw 138 is in the position shown to closely confine the tab 144a between the screw head 148 and the E-ring 150 so that the tab and the plate 134 will move as the screw 138 moves back and forth in the tapped hole 147 in the cross member 142.

The locking screws 136 project through elongated slots 152 in a side edge portion of the plate 134 which extends beyond one side of the switch 126 and are threaded into tapped holes 154 in the base plate 132. As previously indicated, the screw 138 can be inserted through the tab 144b and threaded into the tapped hole 147 from the opposite direction for adjustment of the plate 132 relative to the plate 132 as needed. The assembly 124 of the present example is particularly useful for placement on a machine table in narrow spaces.

Although the present invention has been described with respect to specific details of certain preferred embodiments thereof, it is not intended that such details limit the scope of this patent other than as specifically set forth in the following claims.

I claim:

1. An adjustable mounting assembly for a limit switch comprising an H-shaped stationary base plate defining two outwardly opening slots therein separated by a cross member, means for securing said base plate to a supporting surface, a movable plate slidably disposed on said base plate for supporting a limit switch thereon, said movable plate containing at least one outwardly projecting tab adapted to fit in one of said slots in relatively close fitting slidable relationship, adjusting means interconnected between said base plate and said movable plate for slidably moving said movable plate on said base plate to adjust the position of said switch relative to said base plate and supporting surface, said adjusting means being connected between said tab and said cross member, and locking means separate and distinct from said adjusting means for securing said movable plate to said base plate for maintaining a selected position of said switch.

2. The assembly of claim 1 wherein said adjusting means is a screw.

3. The assembly of claim 1 wherein said adjusting means comprises a screw having a screw head of larger diameter than a shank thereof, said shank containing an untapped portion next to said screw head whose length is slightly greater than the distance through at least one of said tabs, said one tab containing an untapped clearance hole therethrough, said cross member containing a tapped hole therethrough which registers with said clearance hole, said screw being inserted through said clearance hole such that said screw head is flush against an outer facing surface of said one tab, said untapped portion of said screw extending through said tab and containing a circular groove therearound which lies slightly inwardly of an inwardly facing surface of said one tab, said assembly further including an E-ring disposed in said groove for relatively closely confining said one tab between said E-ring and said screw head, a threaded end portion of said screw extending through said tapped hole in said cross member, whereby rotation of said screw causes movement of said screw along said tapped hole and corresponding sliding movement of said movable plate along said base plate in a direction parallel to the centerline of said screw.

4. The assembly of claim 1 wherein said movable plate is separate and distinct from said limit switch.

5. An adjustable mounting assembly for a limit switch comprising a stationary base plate containing a base portion attachable to said supporting surface and a movable plate supporting portion extending at a right angle to said base portion, means for securing said base plate to a supporting surface, a movable plate slidably disposed on said base plate for supporting a limit switch thereon, adjusting means interconnected between said base plate and said movable plate for slidably moving said movable plate on said base plate to adjust the position of said switch relative to said base plate and supporting surface, and locking means separate and distinct from said adjusting means for securing said movable plate to said base plate for maintaining a selected position of said switch.

6. The assembly of claim 5 wherein said adjusting means is a screw.

7. The assembly of claim 5 wherein said movable plate is separate and distinct from said limit switch.

8. An adjustable mounting assembly for a limit switch comprising a stationary base plate, means for securing said base plate to a supporting surface, a movable plate slidably disposed on said base plate for supporting a limit switch thereon, said movable plate containing opposite side edge portions which extend outwardly beyond opposite sides of said switch, each of said side edge portions containing an elongated slot which extends parallel to a longitudinal centerline of said switch, adjusting means interconnected between said base plate and said movable plate for slidably moving said movable plate on said base plate to adjust the position of said switch relative to said base plate and supporting surface, and locking means separate and distinct from said adjusting means for securing said movable plate to said base plate for maintaining a selected position of said switch, said locking means comprising a pair of threaded fasteners which extend through said slots into tapped holes in said base plate which are located on the longitudinal centerline of said slots.

9. The assembly of claim 8 wherein said adjusting means is a screw.

10. The assembly of claim 8 wherein said movable plate is separate and distinct from said limit switch.

11. An adjustable mounting assembly for a limit switch comprising a stationary base plate, means for securing said base plate to a supporting surface, a movable plate slidably disposed on said base plate for supporting a limit switch thereon, said movable plate containing one side edge portion which extends outwardly beyond one side of said switch, said side edge portion containing a pair of spaced, elongated slots which extend parallel to one another and to said supporting surface in a direction perpendicular to a centerline of said switch, adjusting means interconnected between said base plate and said movable plate for slidably moving said movable plate on said base plate to adjust the position of said switch relative to said base plate and supporting surface, and locking means separate and distinct from said adjusting means for securing said movable plate to said base plate for maintaining a selected position of said switch, said locking means comprising a pair of threaded fasteners which extend through said slots into tapped holes in said base plate which are located on the longitudinal centerline of said slots.

12. The assembly of claim 11 wherein said adjusting means is a screw.

13. The assembly of claim 11 wherein said movable plate is separate and distinct from said limit switch.

14. An adjustable mounting assembly for a limit switch comprising a stationary base plate, means for securing said base plate to a supporting surface, a movable plate slidably disposed on said base plate for supporting a limit switch thereon, said movable plate containing one side edge portion which extends outwardly beyond one side of said switch, said side edge portion containing a pair of elongated slots in line with one another parallel to a longitudinal centerline of said switch, adjusting means interconnected between said base plate and said movable plate for slidably moving said movable plate on said base plate to adjust the position of said switch relative to said base plate and supporting surface, and locking means separate and distinct from said adjusting means for securing said movable plate to said base plate for maintaining a selected position of said switch, said locking means comprising a pair of threaded fasteners which extend through said slots into tapped holes in said base plate which are located on the longitudinal centerline of said slots.

15. The assembly of claim 14 wherein said adjusting means is a screw.

16. The assembly of claim 14 wherein said movable plate is separate and distinct from said limit switch.

17. An adjustable mounting assembly for a limit switch comprising a stationary H-shaped base plate defining a pair of outwardly opening slots located on opposite sides of a cross member, said cross member having a tapped hole therethrough, means for securing said base plate to a supporting surface, a flat, rectangularly shaped movable plate disposed on said base plate for supporting a limit switch thereon and having at least one tab located on and projecting away from a broad surface of said movable plate on an edge portion of said movable plate, said one tab projecting into one of said slots in relatively close fitting slidable relationship with the defining surfaces of said one slot, said one tab containing an untapped clearance hole therethrough which registers with said tapped hole, an adjusting screw having a screw head of larger diameter than its shank, a neck portion of said shank next to said screw head being untapped and of length sufficient to extend through said clearance hole and beyond an inwardly facing surface of said one tab, said untapped neck portion containing a circular groove upon and around an end portion thereof which lies just inward of said inwardly facing tab surface when said screw head is flush against an outwardly facing surface of said one tab, an E-ring disposed in said groove such that said one tab is relatively closely confined between said E-ring and said screw head when a threaded end portion of said screw is threadably inserted in said tapped hole, and means for selectively locking said movable plate to said base plate.

* * * * *